US007462980B2

(12) United States Patent
Kim et al.

(10) Patent No.: US 7,462,980 B2
(45) Date of Patent: Dec. 9, 2008

(54) CATHODE RAY TUBE

(75) Inventors: Mun-Seong Kim, Suwon-si (KR); Joon-Soo Bae, Suwon-si (KR); Chang-Ryon Byon, Suwon-si (KR); Hoo-Deuk Kim, Suwon-si (KR); Rog Hur, Suwon-si (KR); Ho-Joong Lee, Suwon-si (KR); Gum-Jong Lee, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 171 days.

(21) Appl. No.: 11/227,971

(22) Filed: Sep. 14, 2005

(65) Prior Publication Data

US 2006/0082282 A1 Apr. 20, 2006

(30) Foreign Application Priority Data

Sep. 17, 2004 (KR) ..... 10-2004-0074604

(51) Int. Cl.
*H01J 29/86* (2006.01)
*H01J 29/92* (2006.01)

(52) U.S. Cl. ..... 313/477 R; 313/480; 220/2.1 A; 220/2.1 R

(58) Field of Classification Search .. 313/364–477 HC; 220/1.1 A, 2.2, 2.1 R, 2.3 A, 2.3 R, 2.1 A
See application file for complete search history.

(56) References Cited

U.S. PATENT DOCUMENTS

| | | | | |
|---|---|---|---|---|
| 6,018,217 | A * | 1/2000 | Fondrk | 313/477 R |
| 6,949,876 | B2 * | 9/2005 | Kugo et al. | 313/477 R |
| 2002/0171349 | A1 * | 11/2002 | Kunitomo et al. | 313/406 |
| 2003/0132696 | A1 * | 7/2003 | Kakigi | 313/477 R |
| 2003/0214220 | A1 * | 11/2003 | Kugo et al. | 313/477 R |
| 2003/0222568 | A1 * | 12/2003 | Baek et al. | 313/477 R |

FOREIGN PATENT DOCUMENTS

| | | | |
|---|---|---|---|
| JP | 03272551 | A * | 12/1991 |
| JP | 2002-358910 | | 12/2002 |
| JP | 2002358910 | A * | 12/2002 |

OTHER PUBLICATIONS

Patent Abstracts of Japan for Publication No. 2002-358910; Date of publication of application Dec. 13, 2002, in the name of Koji Kuwabara et al.
European Search Report, dated Mar. 3, 2006, for Application No. 05108458.0, in the name of Samsung SDI Co., Ltd.

* cited by examiner

*Primary Examiner*—Mariceli Santiago
*Assistant Examiner*—Jose M Diaz
(74) *Attorney, Agent, or Firm*—Christie, Parker & Hale, LLP

(57) ABSTRACT

A cathode ray tube includes a panel with a sealing surface, and a funnel with a sealing surface contacting the sealing surface of the panel. The panel and the funnel each have a thickness varied at the sealing surface thereof.

9 Claims, 6 Drawing Sheets

CATHODE RAY TUBE

CROSS REFERENCE TO RELATED APPLICATIONS

This application claims priority of Korean Patent Application No. 10-2004-0074604, filed Sep. 17, 2004, the entire disclosure of which is incorporated herein by reference.

FIELD OF THE INVENTION

The present invention relates to a cathode ray tube, and in particular, to a cathode ray tube which optimizes the thickness of a panel and a funnel to minimize the weight thereof, achieve superior explosion resistance characteristic, and allow the common use of parts and facilities.

BACKGROUND OF THE INVENTION

Generally, a cathode ray tube is formed with a vacuum vessel where a panel, a funnel and a neck are sealed to each other in a body. A phosphor film is formed on the inner surface of the panel, and an electron gun is mounted within the neck. A mask assembly is internally fitted to the panel and a deflection unit is externally mounted around the funnel.

With the above-structured cathode ray tube, the electron beams emitted from the electron gun are deflected by the deflection unit, and scanned toward the phosphor film. The electron beams pass through the mask holes of the mask assembly, and collide against the phosphor film formed on the inner surface of the panel, thereby emitting light and displaying the desired image.

With the conventional cathode ray tube, the maximum deflection angle of the electron beams is established to be in the range of 102~106°. In order to correctly land the electron beams on the relevant areas of the phosphor film within the range of the maximum deflection angle, the electron gun should be spaced apart from the phosphor film with a distance sufficiently large to deflect the electron beams.

Accordingly, the conventional cathode ray tube has a large tube thickness and a large volume, accompanying with the disadvantages related thereto.

Recently, the deflection of the electron beams has been wide-angled (the maximum deflection angle being about 125°) to slim the cathode ray tube, and in this case, the thickness of the panel and the funnel should be enlarged to achieve a reasonable explosion resistance characteristic.

However, in order to enlarge the thickness of the panel and the funnel while maintaining the conventional external dimension thereof, the internal dimension of the panel and funnel is reduced so that it becomes difficult to use the existing facilities and parts of the cathode ray tube (such as a frame of the mask assembly, a spring for suspending the mask assembly to the interior of the panel, etc.) therefore, and there is a need for a new investment (related to the facility and the mold). This results in increased production cost.

Above all, when the panel and the funnel are thickened, the weight of the cathode ray tube is increased, thereby incurring the difficulty in handling.

SUMMARY OF THE INVENTION

In one embodiment, the present invention is a cathode ray tube which locally enlarges the thickness of a panel and a funnel while enabling the common use of the existent parts and facilities and minimizing the weight thereof.

The cathode ray tube includes a panel with a sealing surface, and a funnel with a sealing surface contacting the sealing surface of the panel. The panel and the funnel have a thickness varied at the sealing surface thereof.

The thicknesses of panel sealing surface and the funnel sealing surface are increasingly enlarged starting from respective corners until a respective maximum thickness is reached approximately in the middle of the respective long sides and short sides. In other words, the thickness of the panel and the funnel may be enlarged while proceeding away from the corners of the sealing surface to the centers thereof.

The panel and the funnel have long sides, short sides and corners each with the sealing surface, and the maximum thickness of the panel at the long sides thereof, the maximum thickness of the panel at the short sides thereof and the thickness of the panel at the corners thereof are different from each other, while the maximum thickness of the funnel at the long sides thereof, the maximum thickness of the funnel at the short sides thereof, and the thickness of the funnel at the corners thereof are different from each other.

With the panel and the funnel having long sides, short sides and corners each with the sealing surface, when the maximum thickness of the panel at the long sides thereof is indicated by Max/Tv1, the maximum thickness of the panel at the short sides thereof by Max/Th1 and the thickness of the panel at the corners thereof by Td1, while the maximum thickness of the funnel at the long sides thereof by Max/Tv2, the maximum thickness of the funnel at the short sides thereof by Max/Th2 and the thickness of the funnel at the corners thereof by Td2, the thickness relation is established to satisfy the following conditions:

$$Max/Tv1 > Max/Th1 \geqq Td1, \text{ and}$$

$$Max/Tv2 > Max/Th2 \geqq Td2.$$

With the panel and the funnel having long sides, short sides and corners each with the sealing surface, when the maximum thickness of the panel at the long sides thereof is indicated by Max/Tv1, the maximum thickness of the panel at the short sides thereof by Max/Th1 and the thickness of the panel at the corners thereof by Td1, while the maximum thickness of the funnel at the long sides thereof by Max/Tv2, the maximum thickness of the funnel at the short sides thereof by Max/Th2, and the thickness of the funnel at the corners thereof by Td2, the thickness relation is established to satisfy the following conditions:

$$Max/Tv1 \geqq Max/Th1 > Td1, \text{ and}$$

$$Max/Tv2 \geqq Max/Th2 > Td2.$$

DETAILED DESCRIPTION

Figure 1:
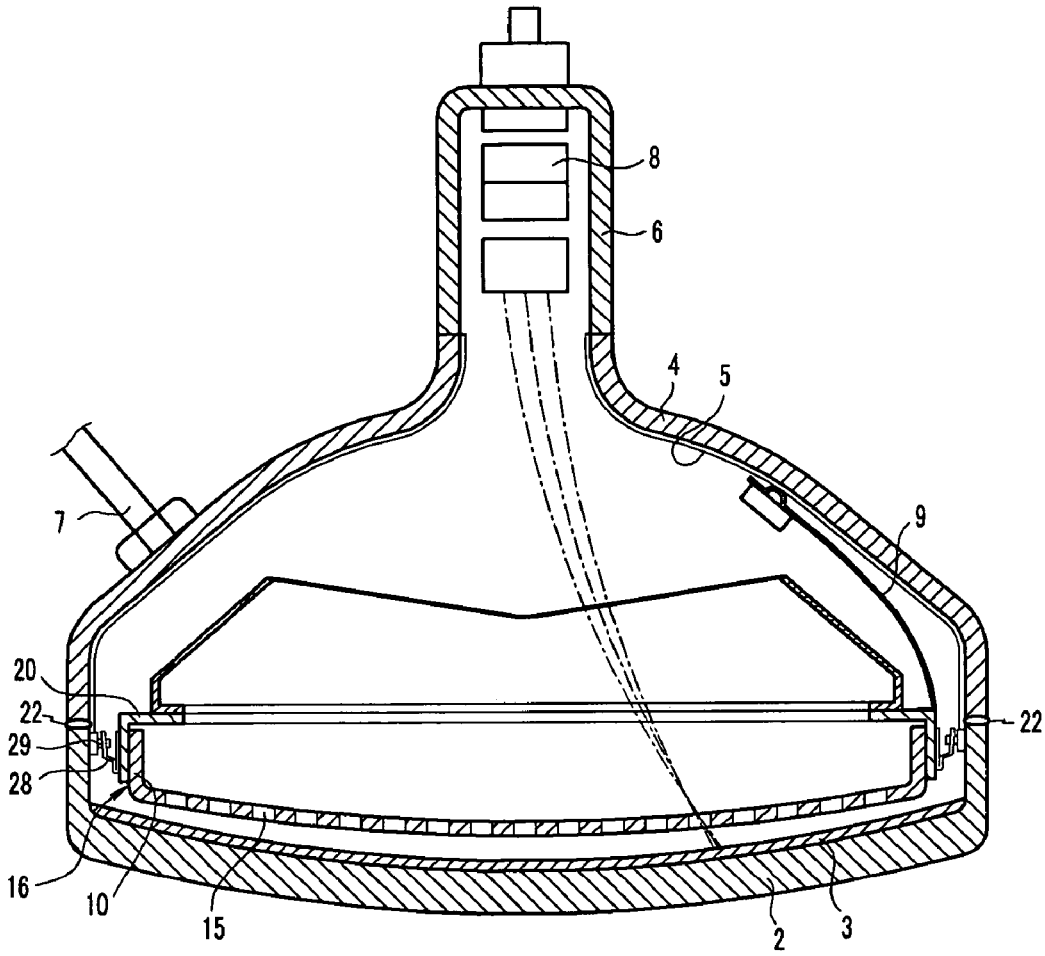
FIG. 1 is a cross sectional view of a cathode ray tube according to an embodiment of the present invention.

As shown in FIG. 1, the cathode ray tube according to an embodiment of the present invention includes a panel 2 and a funnel 4 each with a sealing surface. A frit glass 22 is applied to the sealing surfaces of the panel 2 and the funnel 4, which are sealed to each other to thereby form a vacuum vessel.

Figure 2:
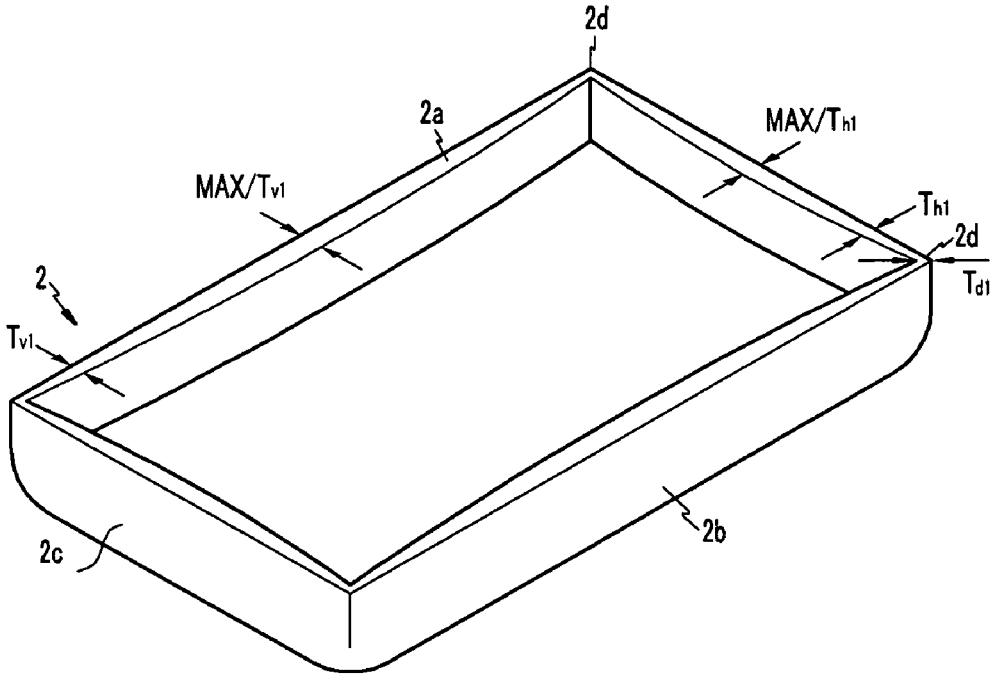
FIG. 2 is a perspective view of a panel for the cathode ray tube according to the embodiment of the present invention.
Figure 3:
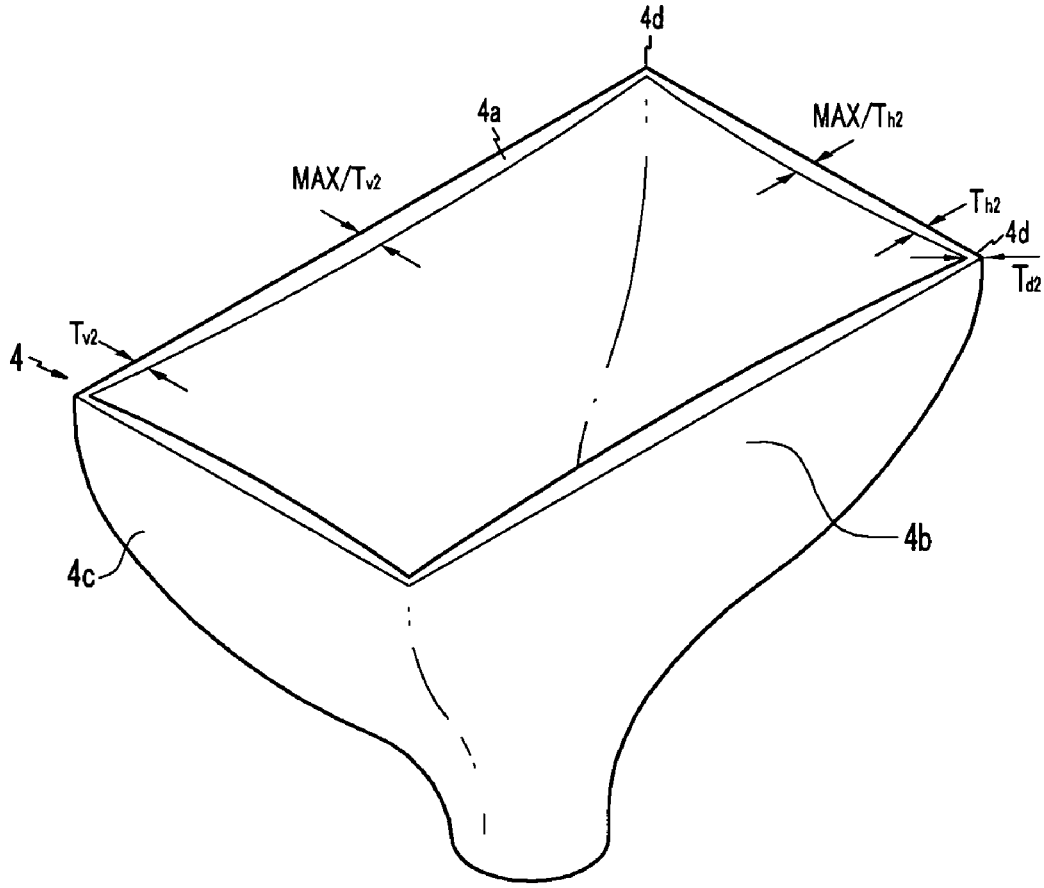
FIG. 3 is a perspective view of a funnel for the cathode ray tube according to the embodiment of the present invention.

As shown in FIGS. 2 and 3, the panel 2 and the funnel 4 have a common shape except that the thickness of each of the sealing surfaces 2*a* of the panel and 4*a* of the funnel is increasingly enlarged at the center relative to the respective corners.

The panel 2 is structured such that the maximum thickness Max/Tv1 of the thickness Tv1 of the long sides 2*b* at the sealing surface 2*a*, and the maximum thickness Max/Th1 of the thickness Th1 of the short sides 2*c* at the sealing surface 2*a* are different from each other.

The funnel 4 is also structured such that the maximum thickness Max/Tv2 of the thickness Tv2 of the long sides 4*b* at the sealing surface 4*a*, and the maximum thickness Max/Th2 of the thickness Th2 of the short sides 4*c* at the sealing surface 4*a* are different from each other.

Specifically, as shown in FIG. 2, the panel 2 is structured such that the long side 2*b* and the short side 2*c* of the sealing surface 2*a* are each increasingly enlarged in thickness starting from respective corners until a respective maximum thickness is reached approximately in the middle of the long side 2*b* and short side 2*c*, respectively. A diagonal thickness Td1 of the corners 2*d* is established to be smaller than the maximum thickness Max/Tv1 of the long sides 2*b* and/or the maximum thickness Max/Th1 of the short sides 2*c*.

As shown in FIG. 3, also with the funnel 4, the thickness Tv2 of the long sides 4*b* and the thickness Th2 of the short sides 4*c* are each increasingly enlarged starting from respective corners until a respective maximum thickness is reached approximately in the middle of the long side 4*b* and short side 4*c*, respectively.

The above varying thickness relation is applied to the inner surfaces of the panel 2 and the funnel 4, and the outer surfaces of the panel 2 and the funnel 4 are established to be similar to that of the common cathode ray tube.

Moreover, with the panel 2 and the funnel 4, the respective thicknesses Td1 and Td2 of the diagonal corners 2*d* and 4*d* are established to be similar to that of the common cathode ray tube having the same screen size. The respective thicknesses Td1 and Td2 of the diagonal corners 2*d* and 4*d* are established such that a corner pin 29 (shown in FIG. 1) fitted to an internal corner of the panel 2 and a spring 28 fixed to a frame 20 of a mask assembly 16 that are combined to mount the mask assembly 16 within the panel 2 do not have any dimensional variation the locations of the corner pin 29 and the spring 28. Accordingly, it is possible to use the existent parts and facilities of the conventional cathode ray tubes.

However, the thickness relation of the panel 2 and the funnel 4 is not limited to the above. In one embodiment, the maximum thickness Max/Tv1 of the long sides 2*b* of the panel 2, and the maximum thickness Max/Th1 of the short sides 2*c* and the thickness Td1 of the corners 2*d* are established to satisfy the following condition:

$$\mathrm{Max}/Tv1 > \mathrm{Max}/Th1 \geqq Td1.$$

Similarly, the maximum thickness Max/Tv2 of the long sides 4*b* of the funnel 4, the maximum thickness Max/Th2 of the short sides 4*c*, and the thickness Td2 of the corners 4*d* are established to satisfy the following condition:

$$\mathrm{Max}/Tv2 > \mathrm{Max}/Th2 \geqq Td2.$$

In one embodiment, the maximum thickness Max/Tv1 of the long sides 2*b* of the panel 2, the maximum thickness Max/Th1 of the short sides 2*c*, and the thickness Td1 of the corners 2*d* are established to satisfy the following condition:

$$\mathrm{Max}/Tv1 \geqq \mathrm{Max}/Th1 > Td1.$$

Likewise, the maximum thickness Max/Tv2 of the long sides 4*b* of the funnel 4, the maximum thickness Max/Th2 of the short sides 4*c*, and the thickness Td2 of the corners 4*d* are established to satisfy the following condition:

$$\mathrm{Max}/Tv2 \geqq \mathrm{Max}/Th2 > Td2.$$

The cathode ray tube including the above structured panel 2 and funnel 4 is then formed with a vacuum vessel with the combination of the panel 2, the funnel 4, and a neck 6, as shown in FIG. 1.

An electron gun 8 is mounted within the neck 6, and a phosphor film 3 is formed on the inner surface of the panel 2. A graphite film 5 is formed on the inner surface of the funnel 4 such that it is connected to an anode 7.

A mask assembly 16 is mounted within the panel 2. The mask assembly 16 includes a mask 10 patterned with a plurality of beam passage holes 15, and a frame 20 for supporting the mask 10.

A getter 9 is installed at the frame 20 to enhance the internal vacuum degree of the vacuum vessel. In order to mount the mask assembly 16 within the panel 2, a corner pin 29 is fitted to the internal corner of the panel 2, and a spring 28 welded to the frame 20 of the mask assembly 16 is combined with the corner pin 29. With the combination of the corner pin 29 and the spring 28, the mask assembly 16 is mounted within the panel 2.

With the above-structured cathode ray tube, the panel 2 and the funnel 4 are varied in thickness along their sealing surfaces, however, the variation in thickness of the panel and the funnel are kept limited within the frame 20 of the mask assembly 16.

This is because the frame 20 is placed sided with the thickness-varied panel 2. When only the frame 20 is altered corresponding to the varied thickness dimension of the panel 2, other parts of the cathode ray tube can be interchangeably used with respective parts of the conventional cathode ray tubes, and hence, new investments for the new parts and production facilities are minimized.

Figure 4:
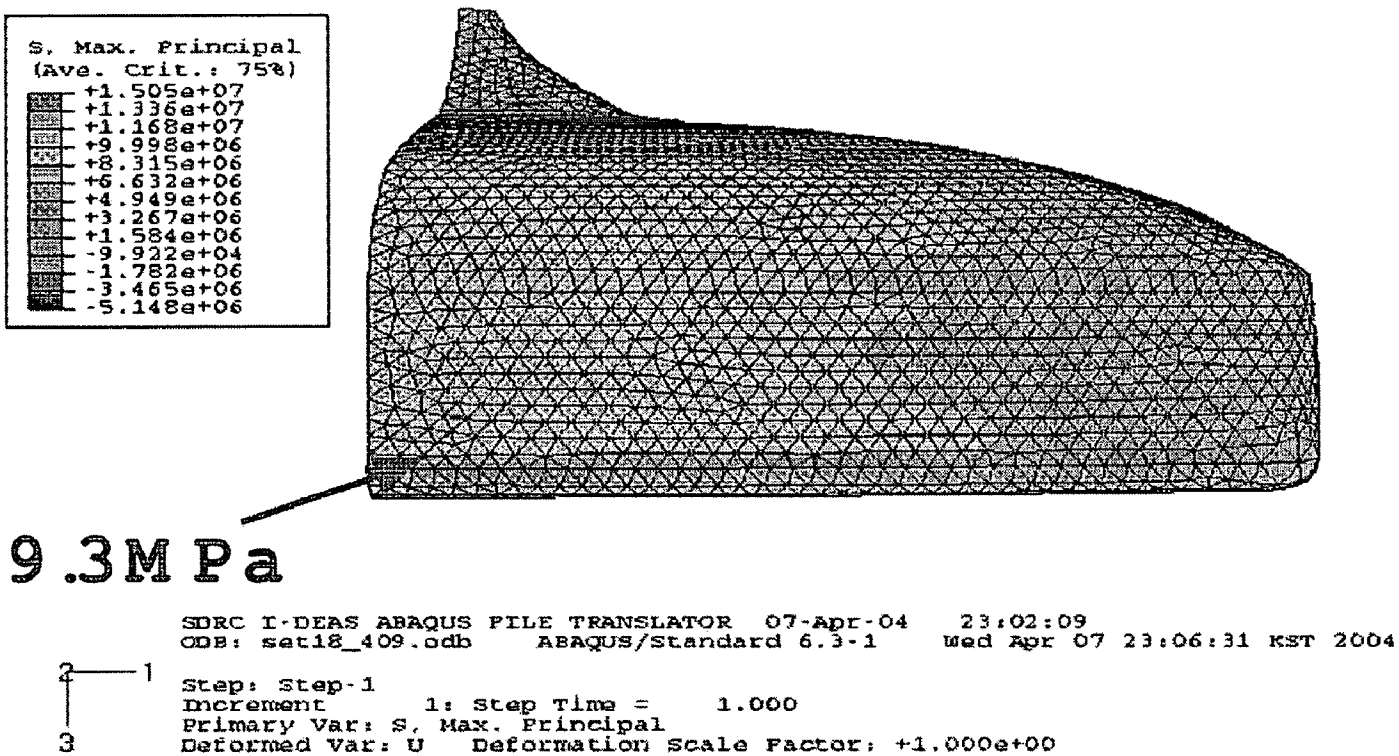
FIG. 4 is a graph illustrating the results of stress interpretation with respect to the long sides of the panel and the funnel of the cathode ray tube according to the embodiment of the present invention, based on a computer simulation.
Figure 5:
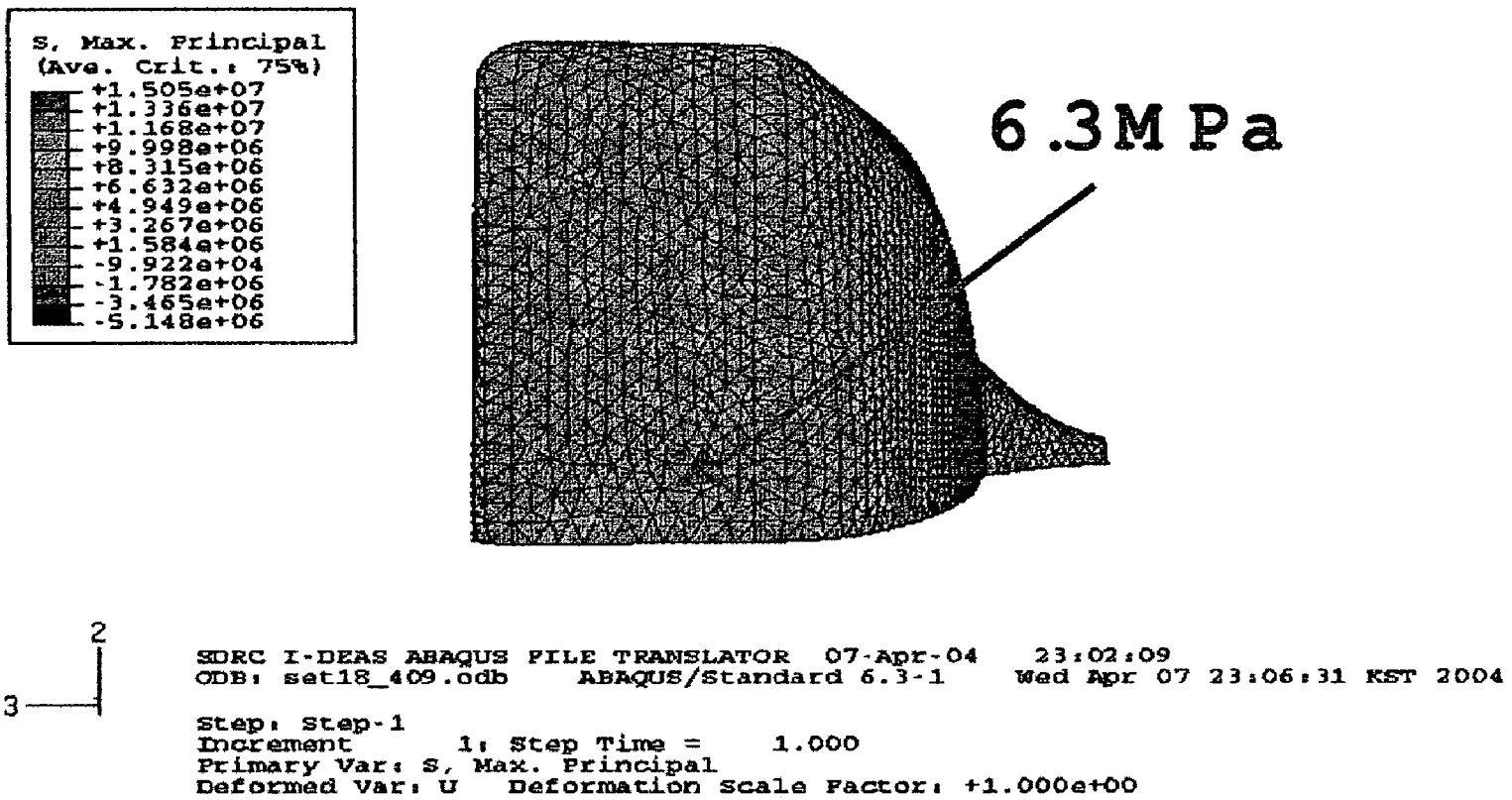
FIG. 5 is a graph illustrating the results of stress interpretation with respect to the short sides of the panel and the funnel of the cathode ray tube according to the embodiment of the present invention, based on a computer simulation.
Figure 6:
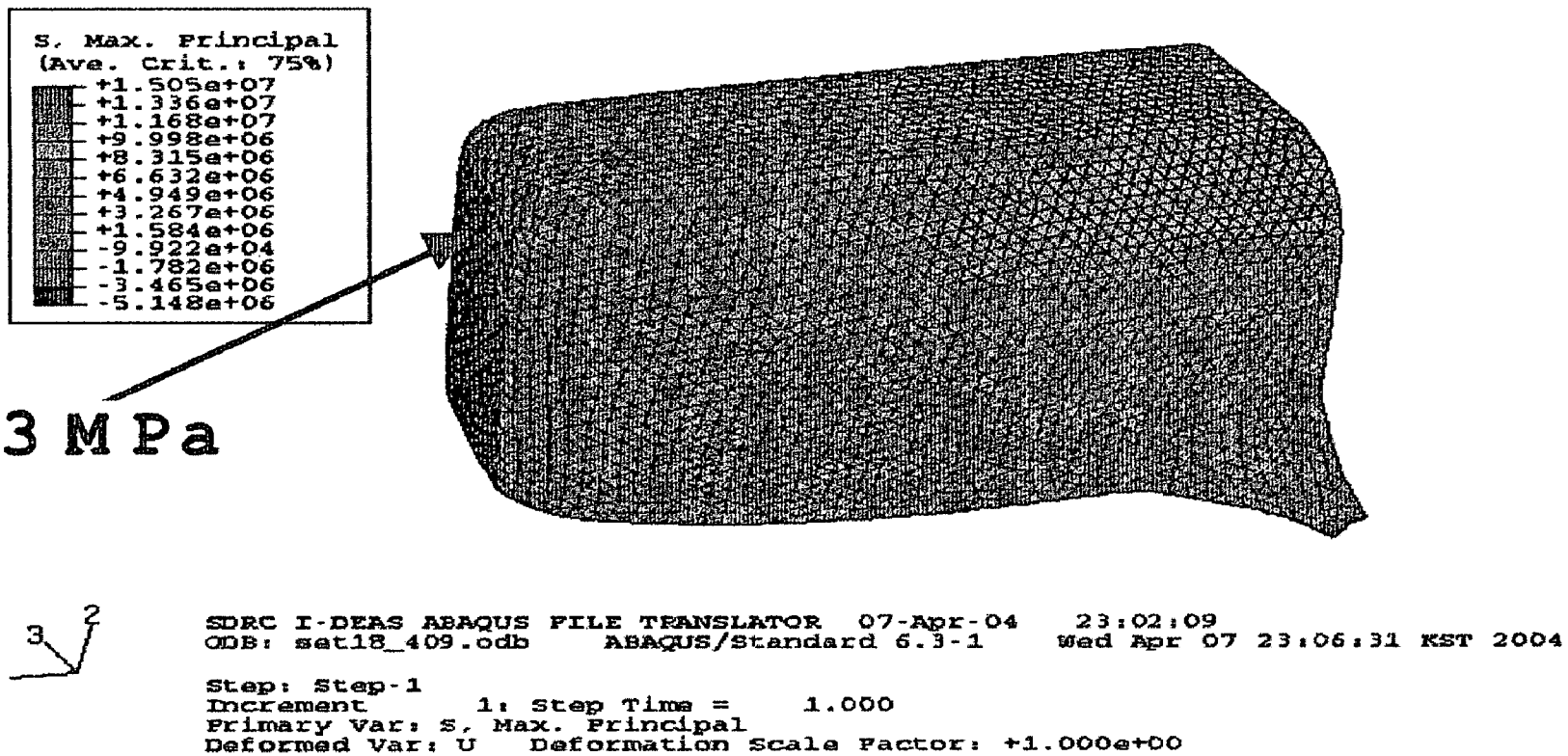
FIG. 6 is a graph illustrating the results of stress interpretation with respect to the corners of the panel and the funnel of the cathode ray tube according to the embodiment of the present invention, based on a computer simulation.

FIGS. 4 to 6 are graphs illustrating the results of interpreting the stress due to the vacuum pressure applied to the panel 2 and the funnel 4 when the shape of the panel 2 and the funnel 4 is varied such that the maximum deflection angle is widened by 125° and the tube thickness is reduced.

As shown in FIG. 4, a stress of 9.3 MPa was applied to the center of the long sides of the panel 2 as well as at the center of the long sides of the funnel 4 based on the sealing surfaces of the panel 2 and the funnel 4, and it was observed that the thickness of those portions (the maximum thickness of the panel and the maximum thickness of the funnel) was preferable to be about 18 mm.

Furthermore, as shown in FIG. 5, a stress of 6.3 MPa was applied to the center of the short sides of the panel 2 as well as at the center of the long sides of the funnel 4 based on the sealing surfaces of the panel 2 and the funnel 4, and it was observed that the thickness of those portions (the maximum thickness of the panel and the maximum thickness of the funnel) was preferable to be about 16 mm.

Similarly, as shown in FIG. 6, a stress of 3 MPa was applied to the corners of the panel as well as at the corners of the funnel based on the sealing surfaces of the panel 2 and the funnel 4, and it was observed that the thickness of those portions (the thickness of the panel and the thickness of the funnel) was preferable to be about 12 mm.

When the thickness of the panel 2 and the funnel 4 is locally varied based on locally differentiated stresses, it is possible to reduce the thickness of the relevant parts corresponding to the surplus stress, compared to the case where the thickness of the panel and the funnel is evenly formed based on the thickness of the portion where the maximum stress is made. Therefore, the total weight of the cathode ray tube can be reduced by the reduced thickness.

With the above-structured cathode ray tube, the thickness of the panel and the funnel can be minimized based on the stress interpretation by way of a computer simulation while achieving an excellent explosion resistance characteristic. Accordingly, it is possible to minimize the weight of the cathode ray tube, and to reduce the material and production costs.

Furthermore, as the corner thickness of the panel is established to be identical with or similar to the conventional one, the existent parts of the conventional cathode ray tubes can be used for production of the improved cathode ray tube of the invention without altering the corner pin and the spring parts for installing the mask assembly. Also, the existent facilities can be commonly used. Consequently, the wide-angled deflection can be made while minimizing the new investment, and the tube thickness can be significantly reduced, thereby constructing a slim cathode ray tube.

Although embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims.

What is claimed is:

1. A cathode ray tube comprising:

a panel with a sealed surface;

a funnel with a sealed surface contacting the sealed surface of the panel; and a neck coupled to the funnel, wherein each of the panel and the funnel has a varying thickness at a respective sealed surface, wherein the thickness of the panel, when sealed with the funnel, is increased while proceeding away from corners of the panel sealed surface and the thickness of the funnel, when sealed with the panel, is increased while proceeding away from corners of the funnel sealed surface.

2. A cathode ray tube comprising:

a panel with a sealing surface;

a funnel with a sealing surface contacting the sealing surface of the panel; and a neck coupled to the funnel, wherein each of the panel and the funnel has a varying thickness at a respective sealing surface, wherein each of the panel sealing surface and the funnel sealing surface has long sides, short sides and corners, the maximum thickness of the panel long sides, the maximum thickness of the panel short sides and the thickness of the panel at the corners are different from each other, and the maximum thickness of the funnel long sides, the maximum thickness of the funnel short sides thereof, and the thickness of the funnel at the corners are different from each other.

3. A cathode ray tube comprising:

a panel with a sealing surface;

a funnel with a sealing surface contacting the sealing surface of the panel; and a neck coupled to the funnel, wherein each of the panel and the funnel has a varying thickness at a respective sealing surface, wherein each of the panel sealing surface and the funnel sealing surface has long sides, short sides and corners, and when the maximum thickness of the panel long sides is indicated by Max/Tv1, the maximum thickness of the panel short sides by Max/Th1, and the thickness of the panel at the corners by Td1, and the maximum thickness of the funnel at the long sides is indicated by Max/Tv2, the maximum thickness of the funnel at the short sides by Max/Th2, and the thickness of the funnel at the corners by Td2, a thickness relation is established to satisfy the following conditions:

$$\text{Max}/Tv1 > \text{Max}/Th1 \geqq Td1, \text{ and}$$

$$\text{Max}/Tv2 > \text{Max}/Th2 \geqq Td2.$$

4. A cathode ray tube comprising:

a panel with a sealing surface;

a funnel with a sealing surface contacting the sealing surface of the panel; and a neck coupled to the funnel, wherein each of the panel and the funnel has a varying thickness along a respective sealing surface, and wherein each of the panel sealing surface and the funnel sealing surface has long sides, short sides and corners and when the maximum thickness of the panel at the long sides is indicated by Max/Tv1, the maximum thickness of the panel at the short sides by Max/Th1, and the thickness of the panel at the corners by Td1, and the maximum thickness of the funnel at the long sides is indicated by Max/Tv2, the maximum thickness of the funnel at the short sides by Max/Th2, and the thickness of the funnel at the corners by Td2, a thickness relation is established to satisfy the following conditions:

$$\text{Max}/Tv1 \geqq \text{Max}/Th1 > Td1, \text{ and}$$

$$\text{Max}/Tv2 \geqq \text{Max}/Th2 > Td2.$$

5. A cathode ray tube comprising:

a panel with a sealing surface;

a funnel with a sealing surface contacting the sealing surface of the panel; and a neck coupled to the funnel, wherein each of the panel and the funnel has a varying thickness at a respective sealing surface, wherein the thickness of the panel is increased while proceeding away from corners of the panel sealing surface and the thickness of the funnel is increased while proceeding away from corners of the funnel sealing surface, and wherein the thicknesses of the panel and the funnel are increased only at respective inner surfaces of the panel and the funnel.

6. A cathode ray tube comprising:

a panel with a sealing surface having four corners, a pair of long sides and a pair of short sides;

a funnel with a sealing surface having four corners, a pair of long sides and a pair of short sides, for coupling to the panel sealing surface; and a neck coupled to the funnel, wherein thicknesses of the panel sealing surface long sides and short sides are each increasingly enlarged starting from respective corners until a respective maximum thickness is reached approximately in the middle of the panel sealing surface long side and short side, respectively, and thicknesses of the funnel sealing surface long sides and short sides are each increasingly enlarged starting from respective corners until a respective maximum thickness is reached approximately in the middle of the funnel sealing surface long side and short side, respectively.

7. The cathode ray tube of claim 6, wherein the thicknesses of the panel sealing surface and the funnel sealing surface are increased only at respective insides of the panel and the funnel.

8. The cathode ray tube of claim 6, wherein the panel sealing surface satisfies the following condition:

$$\mathrm{Max}/Tv1 \geqq \mathrm{Max}/Th1 \geqq Td1,$$

where Max/Tv1 is the maximum thickness of the panel at the long sides, Max/Th1 is the maximum thickness of the panel at the short sides, and Td1 is the thickness of the panel at the corners.

9. The cathode ray tube of claim 6, wherein the funnel sealing surface satisfies the following condition:

$$\mathrm{Max}/Tv2 \geqq \mathrm{Max}/Th2 \geqq Td2,$$

where Max/Tv2 is the maximum thickness of the funnel at the long sides, Max/Th2 is the maximum thickness of the funnel at the short sides, and Td2 is the thickness of the funnel at the corners.

* * * * *